US009721514B2

(12) United States Patent
Li et al.

(10) Patent No.: US 9,721,514 B2
(45) Date of Patent: Aug. 1, 2017

(54) METHOD FOR DRIVING REFLECTIVE LCD PANEL

(75) Inventors: Yuet-Wing Li, Tainan County (TW); Chien-Liang Wu, Tainan County (TW); Kuan-Hsu Fan-Chiang, Tainan County (TW)

(73) Assignee: Himax Display, Inc., Tainan (TW)

( * ) Notice: Subject to any disclaimer, the term of this patent is extended or adjusted under 35 U.S.C. 154(b) by 765 days.

(21) Appl. No.: 13/007,261

(22) Filed: Jan. 14, 2011

(65) Prior Publication Data

US 2012/0019565 A1 Jan. 26, 2012

Related U.S. Application Data

(60) Provisional application No. 61/367,850, filed on Jul. 26, 2010.

(51) Int. Cl.
*G09G 3/36* (2006.01)
*G09G 3/34* (2006.01)

(52) U.S. Cl.
CPC ..... *G09G 3/3614* (2013.01); *G09G 3/3413* (2013.01); *G09G 3/3655* (2013.01); *G09G 2310/0235* (2013.01); *G09G 2310/08* (2013.01); *G09G 2320/0242* (2013.01)

(58) Field of Classification Search
CPC ... G09G 5/00; G09G 5/10; G09G 3/36; G02F 1/133553; G02F 2203/02; G02F 1/133555; G02F 1/1335
USPC ..... 345/102, 204, 88, 87, 84, 211, 89, 690; 349/114
See application file for complete search history.

(56) References Cited

U.S. PATENT DOCUMENTS

2004/0125056 A1* 7/2004 Mi ..... G09G 3/3629 345/87
2007/0035492 A1* 2/2007 Chang ..... 345/87
2007/0075960 A1* 4/2007 Ito ..... 345/98
2008/0074592 A1* 3/2008 Araki ..... G09G 3/3688 349/114

(Continued)

FOREIGN PATENT DOCUMENTS

CN 1937026 3/2007
TW 200739507 10/2007

(Continued)

OTHER PUBLICATIONS

"First Office Action of China Counterpart Application", issued on Jul. 27, 2012, p. 1-p. 4, in which the listed reference was cited.

(Continued)

*Primary Examiner* — Benjamin C Lee
*Assistant Examiner* — Chun-Nan Lin
(74) *Attorney, Agent, or Firm* — J.C. Patents

(57) ABSTRACT

A method for driving a reflective LCD panel is provided. The driving method includes following steps: the reflective LCD panel is driven by a driving signal with alternate positive and negative polarities, wherein the driving signal has positive polarity for a first driving duration and the driving signal has negative polarity for a second driving duration; a color beam is provided to irradiate the reflective LCD panel during a partial time period of the first driving duration; and the color beam is provided to irradiate the reflective LCD panel during a partial time period of the second driving duration.

4 Claims, 3 Drawing Sheets

(56) References Cited

U.S. PATENT DOCUMENTS

| | | | | |
|---|---|---|---|---|
| 2008/0079679 | A1* | 4/2008 | Ozawa | G09G 3/3659 345/89 |
| 2008/0252625 | A1* | 10/2008 | Liao | G09G 3/3406 345/204 |
| 2008/0259068 | A1* | 10/2008 | Liu et al. | 345/211 |
| 2008/0291223 | A1* | 11/2008 | Yamazaki | G09G 3/3614 345/690 |
| 2009/0121993 | A1* | 5/2009 | Masumura | 345/88 |
| 2010/0039358 | A1* | 2/2010 | Lin | 345/84 |
| 2010/0260418 | A1* | 10/2010 | Tsai | H04N 13/0029 382/166 |
| 2010/0321353 | A1* | 12/2010 | Bae | G09G 3/3614 345/205 |

FOREIGN PATENT DOCUMENTS

| | | |
|---|---|---|
| TW | 200841316 | 10/2008 |
| TW | 201011723 | 3/2010 |

OTHER PUBLICATIONS

"Third Office Action of China Counterpart Application", issued on May 21, 2013, p. 1-p. 4, in whcih the listed reference was cited.
"Second Office Action of China counterpart application" issued on Dec. 17, 2012, p. 1-p. 4, in which the listed reference was cited.
"Office Action of Taiwan Counterpart Application", issued on Dec. 20, 2013, p. 1-p. 7, in which the listed reference was cited.

* cited by examiner

METHOD FOR DRIVING REFLECTIVE LCD PANEL

CROSS-REFERENCE TO RELATED APPLICATION

This application claims the priority benefit of U.S. provisional application Ser. No. 61/367,850, filed on Jul. 26, 2010. The entirety of the above-mentioned patent application is hereby incorporated by reference herein and made a part of this specification.

BACKGROUND OF THE INVENTION

1. Field of the Invention

The invention generally relates to a method for driving a liquid crystal display panel (LCD panel), and more particularly, to a method for driving a reflective LCD panel.

2. Description of Related Art

In a color display, each color spot comprises in fact three color beams with different colors. Generally, the color spot is formed by mixing up a red beam, a green beam and a blue beam. When lights with different colors enter human eyes, the lights are mixed up on the retinas thereof so as to have a colorful perception, wherein the above-mentioned mechanism of producing colourful perceptions is referred as color sequential method. The displaying time of each light source is defined as a time period of an image color field. When the lights of three subsequent image color fields are incident on and stimulate the human eyes, after the action of the human eye's vision system, a color image frame is formed.

In terms of a reflective LCD, in order to display images by using the color sequential method, a color beam source is often used to provide different color beams during different image color fields and the color beams irradiate the reflective LCD panel, so that the display panel can sequentially reflect different color beams to form desired images to be displayed. Taking a liquid crystal on silicon panel (LCoS panel) as an example, usually light emitting diodes (LEDs) are used to serve as a color beam source. The light source can provide different color beams by sequentially lighting up the LEDs with different colors during different image color fields.

However in the related technique, if the lighted up time lengths of the LEDs for driving durations of different polarities during a same image color field are different, the periods of the display panel under the irradiations of the color beams respectively corresponding to the different polarities would be asymmetric. The asymmetric lighted up time would lead to defects of marble mura and image sticking present on the display panel.

SUMMARY OF THE INVENTION

Accordingly, the invention is directed to a method for driving a reflective LCD panel, which can avoid the display panel from producing the defects of marble mura and image sticking.

The invention provides a method for driving a reflective LCD panel. The driving method includes following steps: driving the reflective LCD panel by a driving signal with alternate positive and negative polarities, wherein the driving signal has positive polarity for a first driving duration and the driving signal has negative polarity for a second driving duration; providing a color beam to irradiate the reflective LCD panel during a partial time period of the first driving duration; and providing the color beam to irradiate the reflective LCD panel during a partial time period of the second driving duration.

In an embodiment of the invention, both the above-mentioned first driving duration and second driving duration belong to the time period of a same image color field.

In an embodiment of the invention, the step of providing the color beam to irradiate the reflective LCD panel in the first driving duration includes: not providing the color beam to irradiate the reflective LCD panel during a first time period of the first driving duration; and providing the color beam to irradiate the reflective LCD panel during a second time period of the first driving duration.

In an embodiment of the invention, the step of providing the color beam to irradiate the reflective LCD panel in the second driving duration includes: not providing the color beam to irradiate the reflective LCD panel during a third time period of the second driving duration; and providing a color beam to irradiate the reflective LCD panel during a fourth time period of the second driving duration.

In an embodiment of the invention, the time lengths of the above-mentioned second time period and fourth time period are the same as each other.

In an embodiment of the invention, the above-mentioned driving method further includes: driving the reflective LCD panel by the driving signal during the time period of a plurality of image color fields, wherein the time period of each image color field includes the first driving duration and the second driving duration.

In an embodiment of the invention, color beams with different colors are provided to irradiate the reflective LCD panel in the time period of the adjacent image color fields.

In an embodiment of the invention, the above-mentioned color beams with different colors include red beam, blue beam and green beam.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
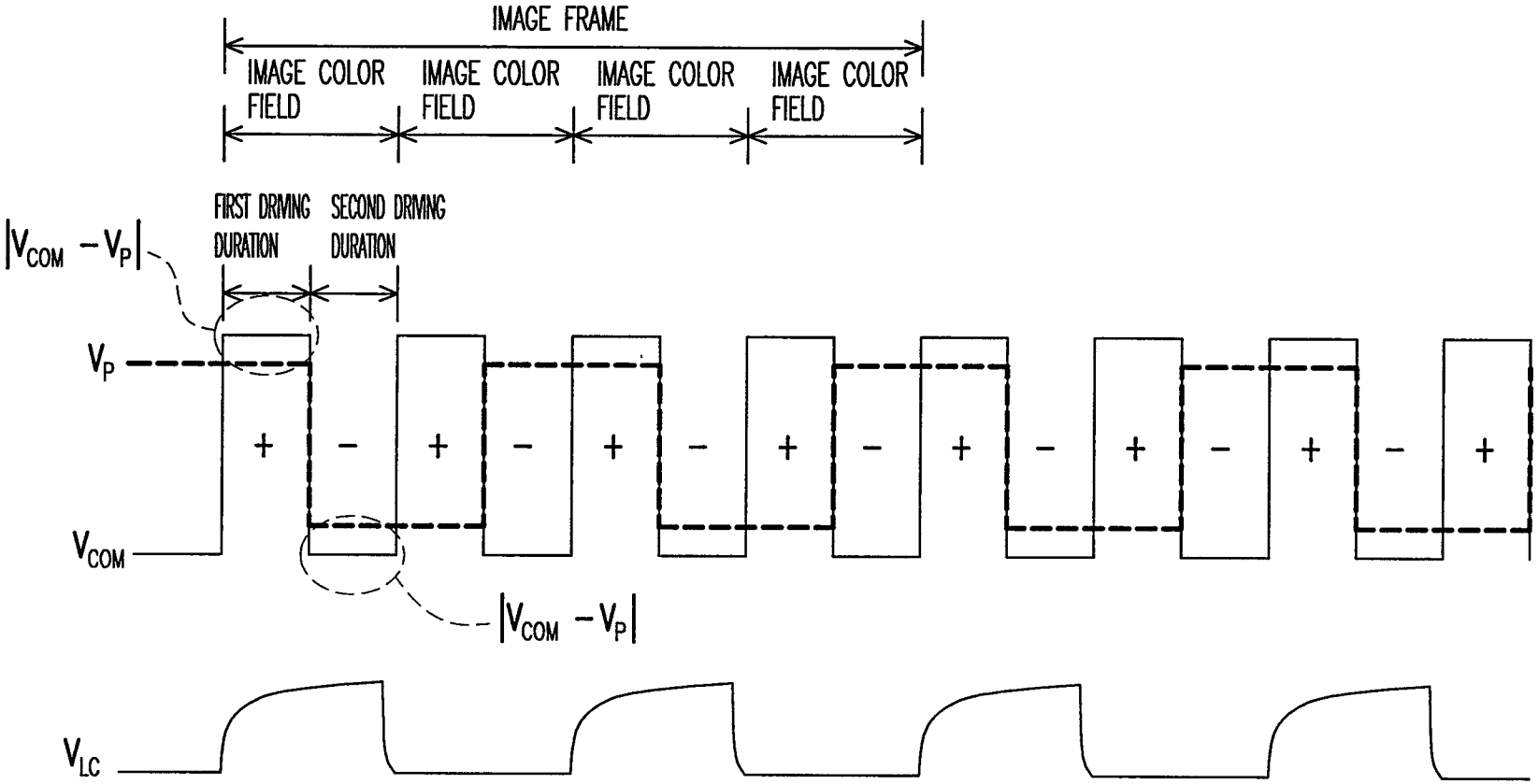
FIG. 1 is a timing diagram of each signal under an ideal status in the driving method according to an embodiment of the invention.

Reference will now be made in detail to the preferred embodiments of the invention, examples of which are illustrated in the accompanying drawings. Wherever possible, the same reference numbers are used in the drawings and the description to refer to the same or like parts.

In following exemplary embodiments, an LCoS panel is selected, but not limited to, for serving as the implemented sample of the reflective LCD panel. In general speaking, in the LCoS panel, the photo-induced current leakage is almost unavoidable. The current leakage easily leads the liquid crystal molecules subject to a DC bias, which further causes the displaying area of the LCD panel producing serious defects of marble mura and image sticking.

In an exemplary embodiment of the invention, a method for driving an LCoS panel is provided. The above-mentioned driving method provides lighted up periods with the same length in the driving durations with different polarities during a same image color field so as to ensure the leakage currents in the driving durations with different polarities reaching an equilibrium status. As a result, the DC bias which the liquid crystal molecules are subject to can be self-compensated so as to eliminate the defects of marble mura and image sticking.

FIG. 1 is a timing diagram of each signal under an ideal status in the driving method according to an embodiment of the invention. Referring to FIG. 1, in the embodiment, the LCoS panel (not shown) is driven by, for example, the color sequential method. The signals in FIG. 1 include a pixel voltage $V_P$, a common voltage $V_{COM}$ and a liquid crystal voltage $V_{LC}$. The common voltage $V_{COM}$ therein is a driving signal with alternate positive and negative polarities for driving the LCoS panel of the embodiment. The positive polarity and the negative polarity of the common voltage $V_{COM}$ at different timings are notated by the positive/negative marks as shown in FIG. 1.

When the LCoS panel is driven by the color sequential method, the color beam source of each color is correspondingly lighted up during the time period of each image color field. When the lights of a plurality of subsequent image color fields are incident on and stimulate the human eyes, after the action of the human eye's vision system, a color image frame is formed. In the embodiment, an image frame includes four image color fields. The time period of each image color field includes a first driving duration and a second driving duration. In other words, the common voltage $V_{COM}$ during the time period of each image color field drives the LCoS panel with alternate positive and negative polarities.

As shown in FIG. 1, under a real status, the difference values $|V_{COM}-V_P|$ of the common voltage $V_{COM}$ and the pixel voltage $V_P$ for the first driving duration and the second driving duration of each image color field are the same as each other so that they are in a symmetric status. However in the LCoS panel, the photo-induced current leakage is almost unavoidable. When the LCoS panel is irradiated, the pixel voltage $V_P$ would be reduced due to the current leakage.

Figure 2:
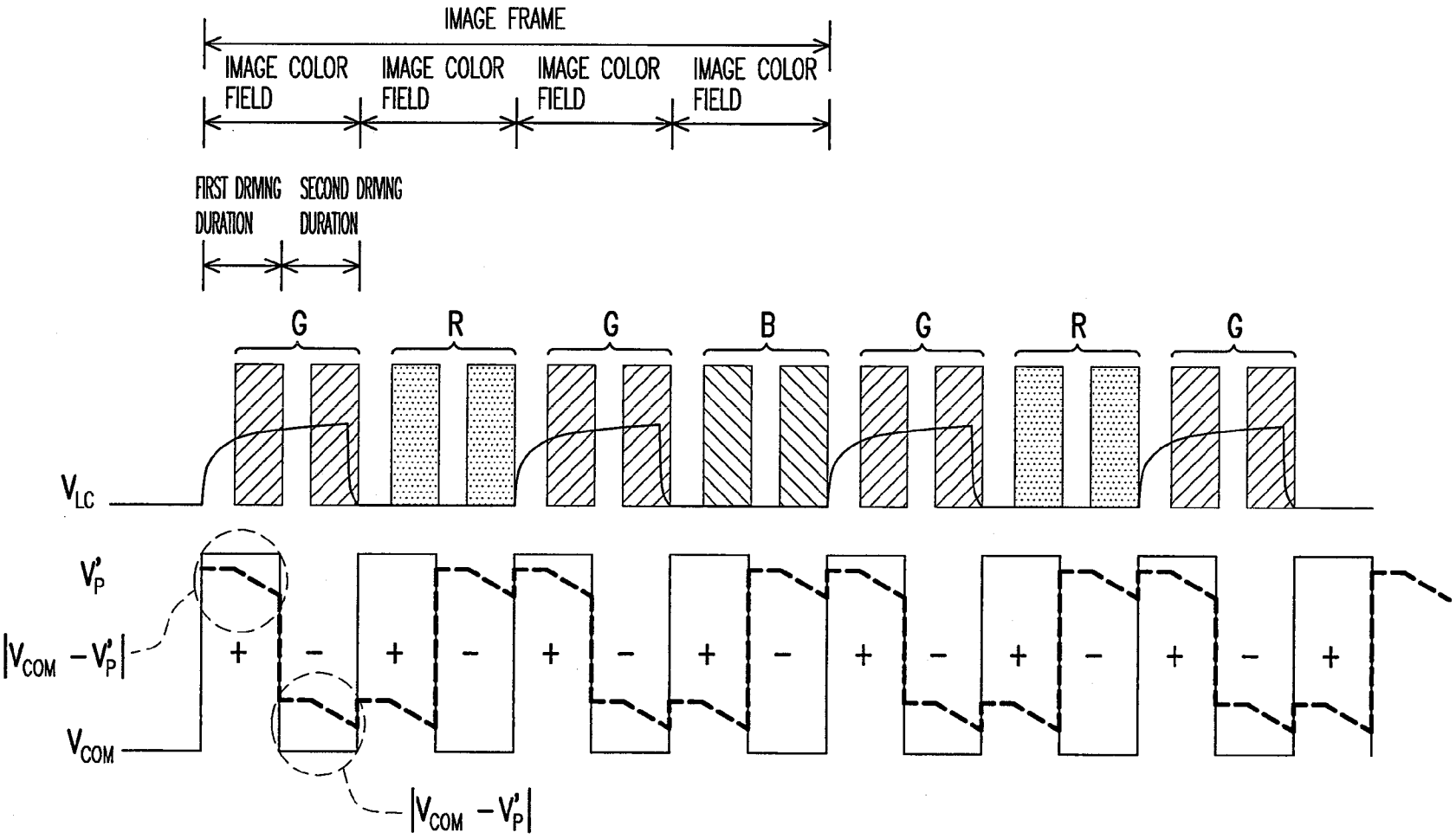
FIG. 2 is a timing diagram of each signal under a real status in the driving method according to the embodiment of FIG. 1.

FIG. 2 is a timing diagram of each signal under a real status in the driving method according to the embodiment of FIG. 1. Referring to FIG. 2, when the color beam source is lighted up, the color beam irradiates the LCoS panel, and the pixel voltage $V_P'$ is reduced due to the current leakage, as shown in FIG. 2.

In order to avoid the pixel voltage $V_P'$ from being reduced due to the current leakage so as to further prevent the difference values of the common voltage $V_{COM}$ and the pixel voltage $V_P'$ from being asymmetric, a color beam is provided to irradiate the LCoS panel during a partial time period of the first driving duration and a color beam of the same color is provided to irradiate the LCoS panel during a partial time period of the second driving duration according to the driving method of the embodiment. In the embodiment, both the first driving duration and the second driving duration belong to the time period of a same image color field, and the above-mentioned two time lengths during which the LCoS panel is irradiated by the color beam are the same as each other.

In the embodiment, on the other hand, the color beams with different colors are provided by the driving method to irradiate the LCoS panel in the time period of adjacent image color fields. Therein, the color beams with different colors include red beam, blue beam and green beam. Taking FIG. 2 as an example, the color beam sources with different colors are sequentially lighted up during different image color fields according to the driving method of the embodiment, and the LCoS panel is irradiated by different light sources, such as GG, RR, GG, BB, GG, . . . , as shown in FIG. 2, during the adjacent image color fields.

Figure 3:
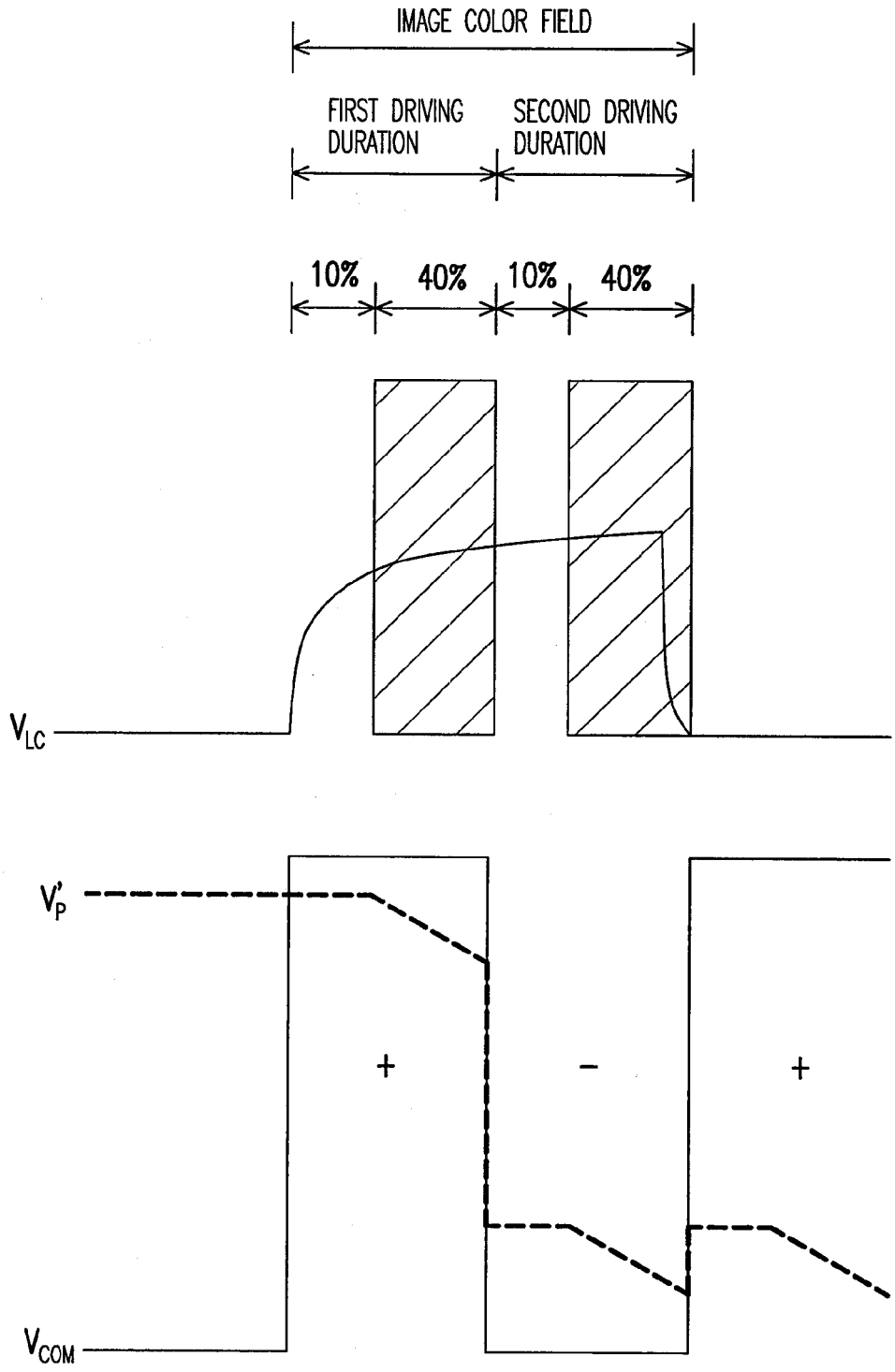
FIG. 3 shows the timing diagram of each signal during one of the image color fields in FIG. 2.

In more details, FIG. 3 shows the timing diagram of each signal during one of the image color fields in FIG. 2. Referring to FIG. 3, a green beam source therein is, for example, lighted up and irradiates the LCoS panel. In the embodiment, no green beam is provided to irradiate the LCoS panel during the first time period of the first driving duration. On the contrary, a green beam is provided to irradiate the LCoS panel during the second time period of the first driving duration. That is to say, the green beam source is not lighted up during the first 10% time period of the image color field (i.e., the first time period), while the green beam source is lighted up during the first 40% time period of the image color field (i.e., the second time period).

After that, the green beam source is not provided to irradiate the LCoS panel during the third time period of the second driving duration. On the contrary, the green beam source is provided to irradiate the LCoS panel during the fourth time period of the second driving duration. That is to say, the green beam source is not lighted up during the second 10% time period of the image color field (i.e., the third time period), while the green beam source is lighted up during the second 40% time period of the image color field (i.e., the fourth time period).

It should be noted that, in the embodiment, the time length of the second time period and the time length of the fourth time period are the same, and both the time lengths respectively occupy 40% the time period of an image color field to avoid the pixel voltage $V_P'$ from being reduced due to the current leakage so as to further prevent the difference values of the common voltage $V_{COM}$ and the pixel voltage $V_P'$ from being asymmetric. It should be noted that, the time ratios 10%, 40%, 10% and 40% in the embodiment are examples, which the invention is not limited to.

Considering the description above, even the LCoS panel has a leakage current caused by the light irradiation, since, by using the driving method of the embodiment, the lighted up time with the same length for the driving durations with different polarities during a same image color field is provided, hence, the falling extents of the pixel voltage $V_P'$ due to the current leakage are the same, which further makes the difference values $|V_{COM}-V_P'|$ of the common voltage $V_{COM}$ and the pixel voltage $V_P'$ in a symmetric status so as to eliminate the defects of marble mura and image sticking produced on the LCoS panel.

In summary, in the exemplary embodiments of the present invention, the said driving method provides lighted up periods with the same length in a driving duration with different polarities during a same image color field so as to ensure the leakage currents in the driving durations with different polarities reaching an equilibrium status. As a result, the defects of marble mura and image sticking produced on the reflective LCD panel can be effectively eliminated.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A method for driving a reflective liquid crystal display (LCD) panel, wherein the reflective LCD panel comprises an active color beam source providing a color beam, comprising:

driving the reflective LCD panel by a driving signal with alternate positive and negative polarities, wherein the driving signal is a common voltage having positive polarity for a first driving duration and negative polarity for a second driving duration during an image color field, wherein the first and second driving durations are consecutive and each consist of a first time period and a second time period, wherein in each of the first and second driving durations, the second time period is after the first time period, and the first time period is shorter than the second time period;

providing, by the active color beam source, the color beam of the active color beam source to irradiate the reflective LCD panel during the second time period of the first driving duration, and not providing the color beam of the active color beam source to irradiate the reflective LCD panel during the first time period of the first driving duration; and providing, by the active color beam source, the color beam of the active color beam source to irradiate the reflective LCD panel during the second time period of the second driving duration, and not providing the color beam of the active color beam source to irradiate the reflective LCD panel during the first time period of the second driving duration, wherein the color beam of the active color beam source irradiates the same color during the first and second driving durations.

2. The driving method as claimed in claim 1, wherein both the first driving duration and the second driving duration belong to the time period of a same image color field.

3. The driving method as claimed in claim 1, wherein color beams with different colors are provided to irradiate the reflective LCD panel in another image color field adjacent to the image color field.

4. The driving method as claimed in claim 3, wherein the color beams with different colors comprise red beam, blue beam and green beam.

* * * * *